United States Patent [19]

Lundblade

[11] Patent Number: 4,502,715

[45] Date of Patent: Mar. 5, 1985

[54] LATCH ASSEMBLY

[75] Inventor: Gene D. Lundblade, Valley Center, Kans.

[73] Assignee: The Coleman Company, Inc., Wichita, Kans.

[21] Appl. No.: 427,949

[22] Filed: Sep. 29, 1982

[51] Int. Cl.[3] ..... E05C 19/02

[52] U.S. Cl. ..... 292/78; 292/100; 292/DIG. 38

[58] Field of Search ..... 292/100, 134, 126, DIG. 38, 292/78, 79, DIG. 30, 195, 196, 200, 336.3, DIG. 31

[56] References Cited

U.S. PATENT DOCUMENTS

| | | | |
|---|---|---|---|
| 1,815,690 | 7/1931 | Wiley | 292/200 |
| 2,028,954 | 1/1936 | Roedding | 292/126 |
| 4,113,292 | 9/1978 | Gauron et al. | 292/336.3 X |
| 4,249,760 | 12/1981 | Conley | 292/83 X |
| 4,312,528 | 1/1982 | Hall et al. | 292/336.3 X |

FOREIGN PATENT DOCUMENTS

| | | | |
|---|---|---|---|
| 137369 | 5/1950 | Australia | 292/200 |

*Primary Examiner*—Gary L. Smith
*Assistant Examiner*—Thomas J. Dubnicka

[57] ABSTRACT

A latch assembly which releases when a predetermined force is applied to it includes a latch and a handle pivotally mounted on a closure member for pivoting movement about parallel axes. The handle includes a projection which extends into a groove in the latch, and the projection and groove lie generally along the line which joins the pivot axes. When the handle is pivoted, the projection pivots the latch. The latch includes a pivot portion, a latching portion, and a connecting portion which connects the latching portion to the pivot portion. The connecting portion is flexible and permits the latching portion to release if a predetermined force is applied to the latching portion.

11 Claims, 22 Drawing Figures

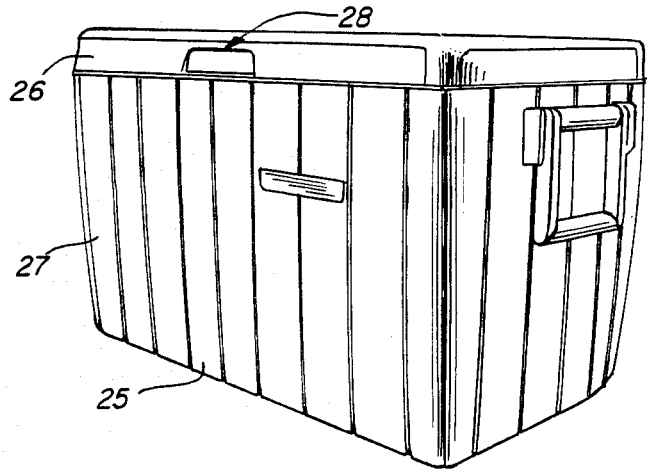
FIG. 1
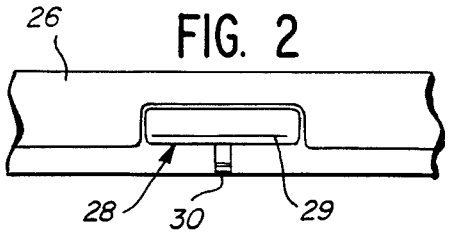
FIG. 2
FIG. 3
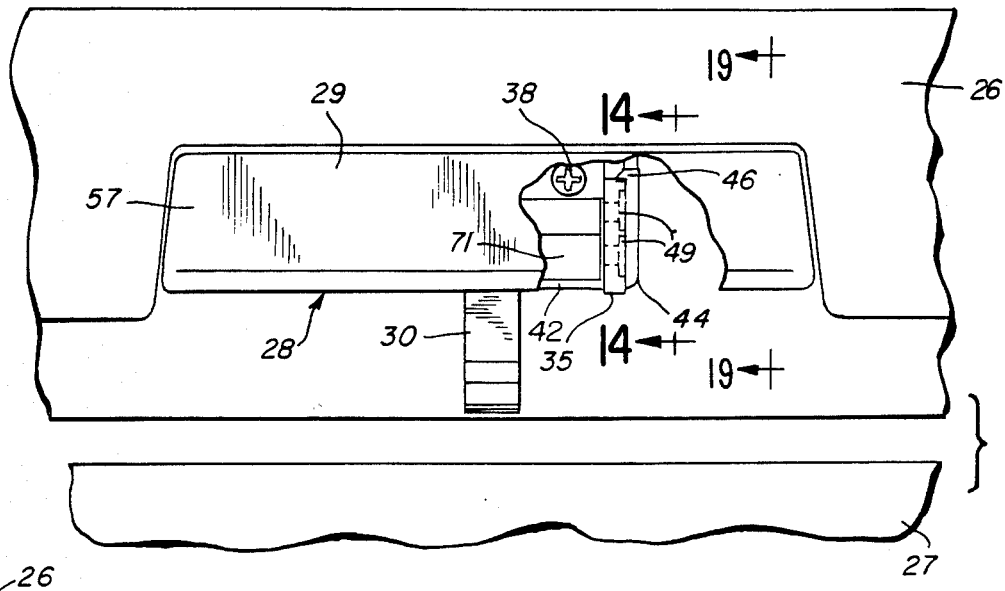
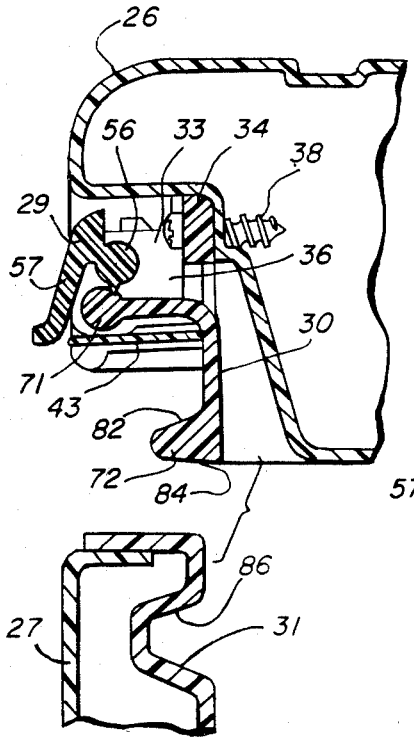
FIG. 4
FIG. 5
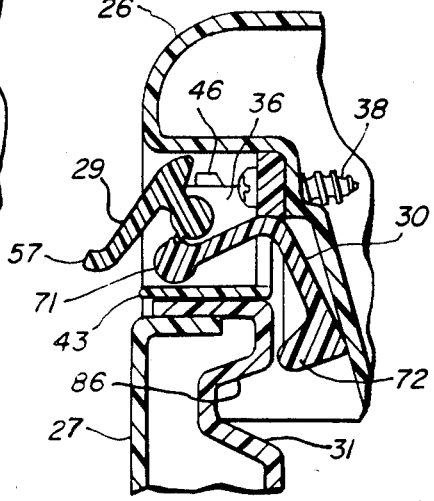
FIG. 6
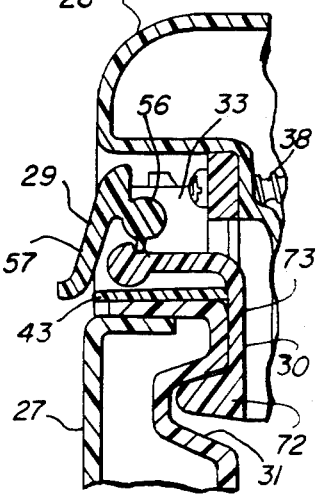

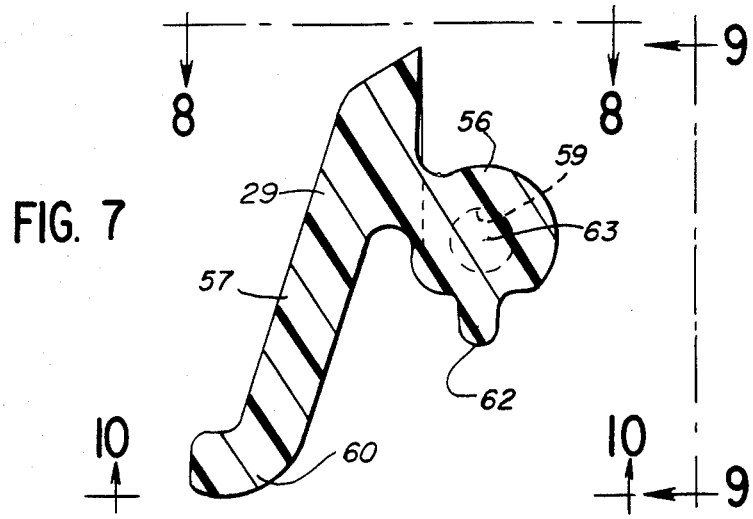
FIG. 7
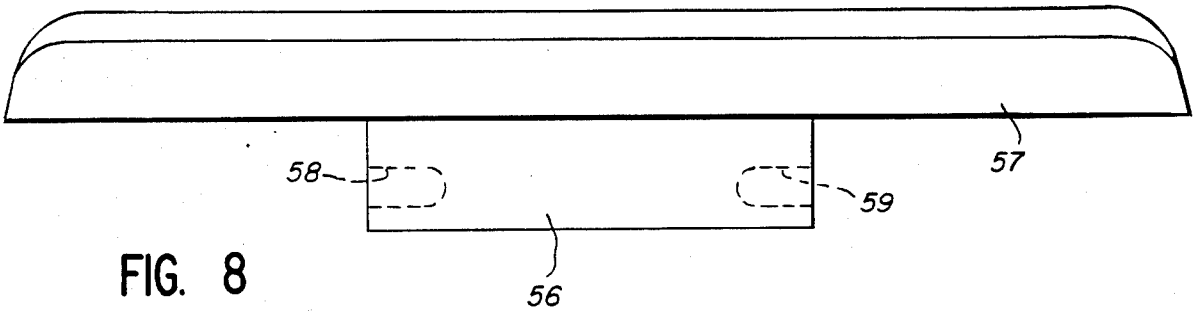
FIG. 8
FIG. 9
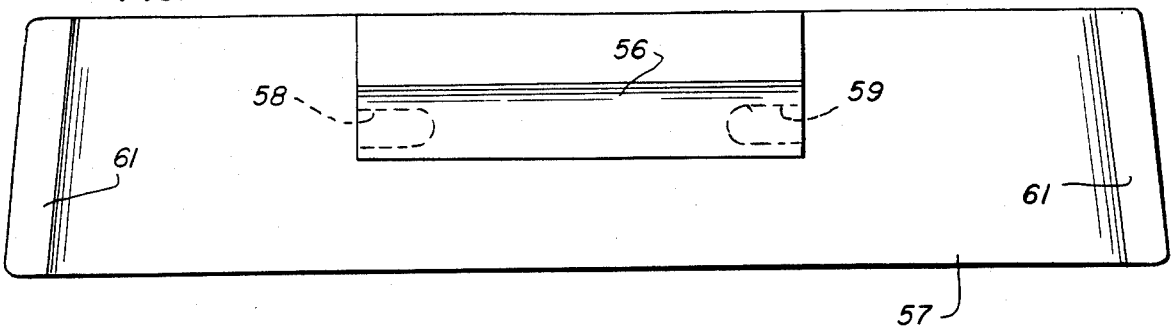
FIG. 10
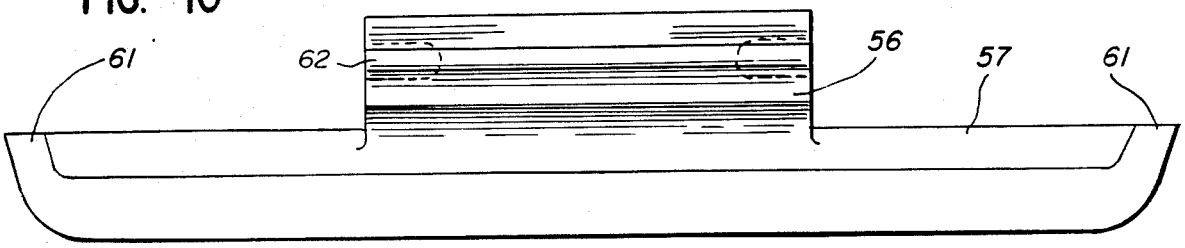

LATCH ASSEMBLY

BACKGROUND AND SUMMARY

This invention relates to a latch assembly, and, more particularly, to a latch assembly which includes a latch which releases when a predetermined opening force is applied to it.

The latch assembly has particular utility with respect to containers, for example, picnic coolers, which include a cover or lid which is hingedly secured to a chest or container body. Such latch assemblies are desirably inexpensive, easy to assemble, and easy to operate, but they must also provide secure latching. Latches for picnic coolers must satisfy still another requirement—the latch must be releasable to permit the lid to open when a certain force is applied to the lid. This safeguards against the possiblity that a child could be trapped inside the cooler. A picnic cooler latch assembly should also require external manipulation in order to move the latch to the latched position and should have a minimum of protruding parts.

Some picnic cooler latches are attached at the front surface of the cooler and have hinged parts which may extend outwardly an inch or more and are thus subject to damage during normal use of the cooler. Other cooler latches have rigid outwardly protruding parts which may inflict pain if contacted during normal use. Picnic cooler latches which require several pounds of force to unlatch the lid require the user to hold the cooler enclosure with one hand while at the same time releasing the latch with the other hand.

U.S. Pat. No. 4,249,760 describes a picnic cooler latch assembly in which a sliding operating knob cams the latch into its latched and unlatched positions. The latch is flexible so that it releases when a sufficient opening force is applied. However, the bi-directional sliding movement of the knob may be confusing to some people.

The invention provides a latch assembly which releases when a predetermined opening force is applied, which automatically moves to the unlatched position when the closure is being shut, which requires external manipulation to move the latch to the latched position, and which requires only one continuous hand movement to first unlatch and then open the closure. The latch assembly includes a latch and a handle which are pivotally mounted on a closure for pivotal movement about parallel axes. A projection on the handle extends into a groove in the latch, and pivoting movement of the latch and the projection causes the latch to pivot. The projection and the groove move over a centerline between the two pivot axes, and the dimensions of the projection and the groove are such that a certain minimum force must be applied to move these parts over the centerline. The latch includes a pivot portion, a latching portion, and a connecting portion which joins the pivot portion and the latching portion. The connecting portion is flexible and permits the latching portion to move sufficiently to cause the latch to move over center to its unlatched position when a predetermined force is applied to the latching portion.

DESCRIPTION OF THE DRAWING

The invention will be explained in conjunction with an illustrative embodiment shown in the accompanying drawing, in which FIG. 1 is a perspective view of a picnic cooler equipped with a latch assembly in accordance with the invention;

FIG. 2 is a fragmentary front elevational view of the lid of the cooler showing the latch assembly;

FIG. 3 is an enlarged fragmentary front elevational view of the lid and the container body of the cooler with the latch assembly partially broken away;

FIG. 4 is a fragmentary sectional view showing the lid in a partially open position and the latch assembly in its latched position;

FIG. 5 is a fragmentary sectional view showing the lid in its closed position and the latch assembly in its unlatched position;

FIG. 6 is a view similar to FIG. 5 showing the latch assembly in its latched position;

FIG. 7 is an enlarged sectional view of the handle of the latch assembly;

FIG. 8 is a top plan view of the handle taken along the line 8—8 of FIG. 7;

FIG. 9 is a rear elevational view of the handle taken along the line 9—9 of FIG. 7;

FIG. 10 is a bottom plan view of the handle taken along the line 10—10 of FIG. 7;

DESCRIPTION OF SPECIFIC EMBODIMENT

Figure 11:
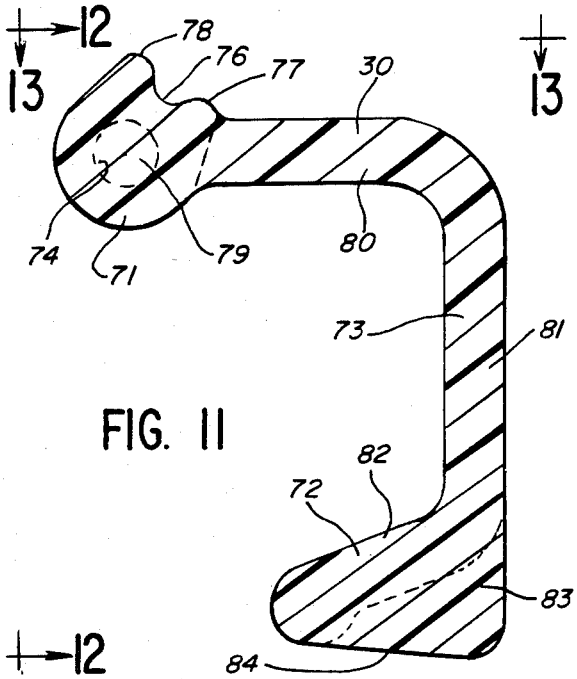
FIG. 11 is an enlarged sectional view of the latch member of the latch assembly.
Figure 14:
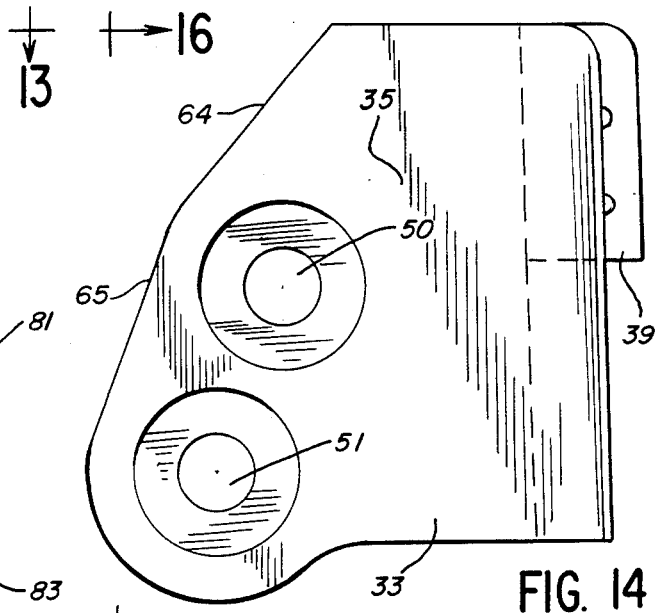
FIG. 14 is a side elevational view of the mounting bracket of the latch assembly as would be seen along the line 14—14 of FIG. 3.

The invention will be explained in conjunction with a picnic cooler 25 shown in FIG. 1. However, it will be understood that the latch assembly can be used in many other situations in which two members are to be releasably latched together. The picnic cooler 25 includes a closure or lid 26 which is hingedly secured to a base or container body 27.

A latch assembly 28 is mounted within a recess in the cover 26 and includes a handle 29 and a latch 30. As will be explained more fully hereinafter, the handle 29 is used both for latching and unlatching the latch assembly and for raising the lid 26. Referring to FIGS. 4–6, the latch 30 extends below the handle 29 and is adapted to be received in a notch or recess 31 in the body 27 of the cooler. The latch 30 is movable between an unlatched position shown in FIG. 5 and a latched position shown in FIG. 6 in which the lid 26 is releasably latched to the body 27.

The handle 29 and the latch 30 are both pivotally mounted in a mounting bracket 33 (see also FIGS. 14 and 16–18). The mounting bracket 33 is generally U-shaped in top plan view (FIG. 17) and includes a back wall 34 and a pair of parallel side walls 35 and 36. The back wall 34 is provided with a pair of slots 37, and the bracket 33 is attached to the lid 26 by a pair of screws 38 (FIG. 4) which extend through the slots 37 and into the lid. A rib 39 (FIGS. 14 and 17) extends rearwardly from the center of the back wall, and four projections 40 extend from the back wall around each slot 37. The rib 39 and the projections 40 embed themselves into the material of the lid 26 and prevent the bracket from shifting after the screws 38 are tightened. The elongated slots 37 permit the position of the bracket relative to the screws to be adjusted to accommodate normal manufacturing tolerances while still providing secure latching between the lid and the base of the cooler.

A generally U-shaped cover 42 (FIGS. 3 and 19–22) surrounds the bracket 33. The cover 42 includes a bottom wall 43 and a pair of parallel upwardly extending side walls 44 and 45. The side walls 35 and 36 of the bracket fit inside the side walls 44 and 45 of the cover (see FIG. 3), and the bottom wall 43 of the cover supports the bottom edges of the side walls 35 and 36 (FIGS. 4 and 5). A detent 46 extends inwardly from the top of each of the side walls 44 and 45 and engages the recess of one of the side walls 35 and 36 to frictionally retain the cover 42 on the bracket 33.

Figure 15:
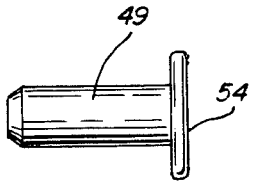
FIG. 15 is a side view of one of the mounting pins for the latch and the handle.

The handle 29 and the latch 30 are pivotally mounted on the bracket 33 by pivot pins 49 (FIG. 15) which extend through openings 50, 51, 52, and 53 (FIGS. 14 and 16) in the side walls 35 and 36 of the bracket. Each of the openings 50–53 is countersunk on the outside surface of the bracket side walls so that the heads 54 of the pins will be flush with the outside surface of the side walls.

Referring to FIGS. 7–10, the handle 29 includes a pivot portion 56 and a gripping portion 57. The pivot portion is sized to be inserted between the side walls 35 and 36 of the bracket 33, and openings 58 and 59 are provided in the ends of the pivot portion for receiving two pivot pins 49. One pin extends through the opening 50 in the side wall 35 and into the opening 58 in the pivot portion, and another pin extends through the opening 52 in the side wall 36 and into the opening 59 in the pivot portion.

The gripping portion 57 extends laterally beyond the sides of the bracket 33 for the full extent of the recess in the lid of the picnic cooler. The lower end of the gripping portion curves outwardly at 60 to provide a convenient portion for engagement by the fingers of the user. The sides 61 of the gripping portion curve inwardly to provide an aesthetic, clean appearance.

The pivot portion 56 of the handle 29 includes a projection 62 (FIG. 7) which extends radially with respect to the axis of rotation 63 of the pivot portion.

Figure 12:
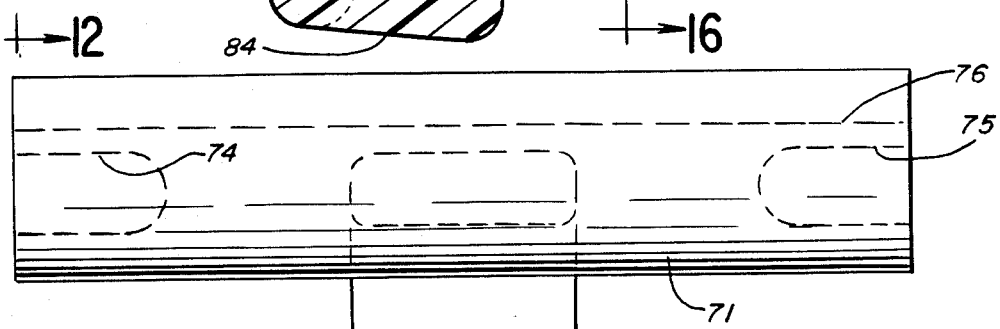
FIG. 12 is a front elevational view of the latch taken along the line 12—12 of FIG. 11.
Figure 12:
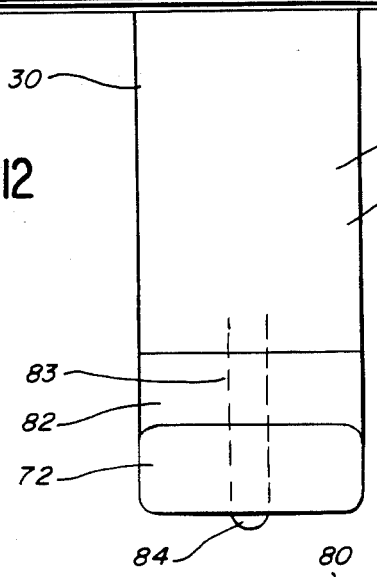
Figure 13:
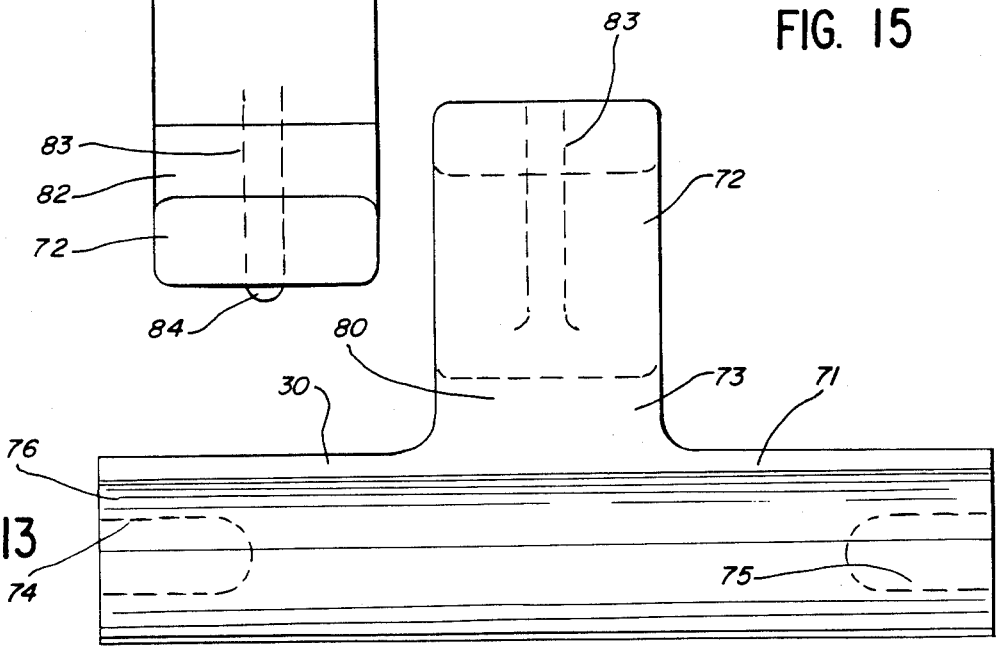
FIG. 13 is a top plan view of the latch taken along the line 13—13 of FIG. 11.
Figure 16:
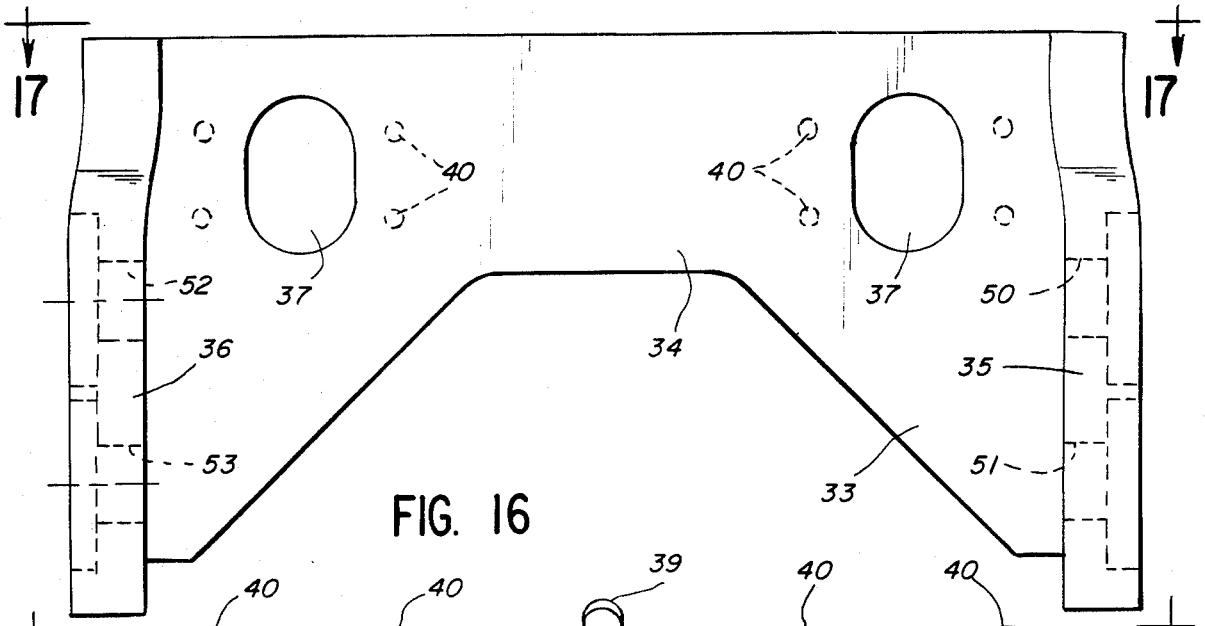
FIG. 16 is a front elevational view of the mounting bracket taken along the line 16—16 of FIG. 14.
Figure 17:
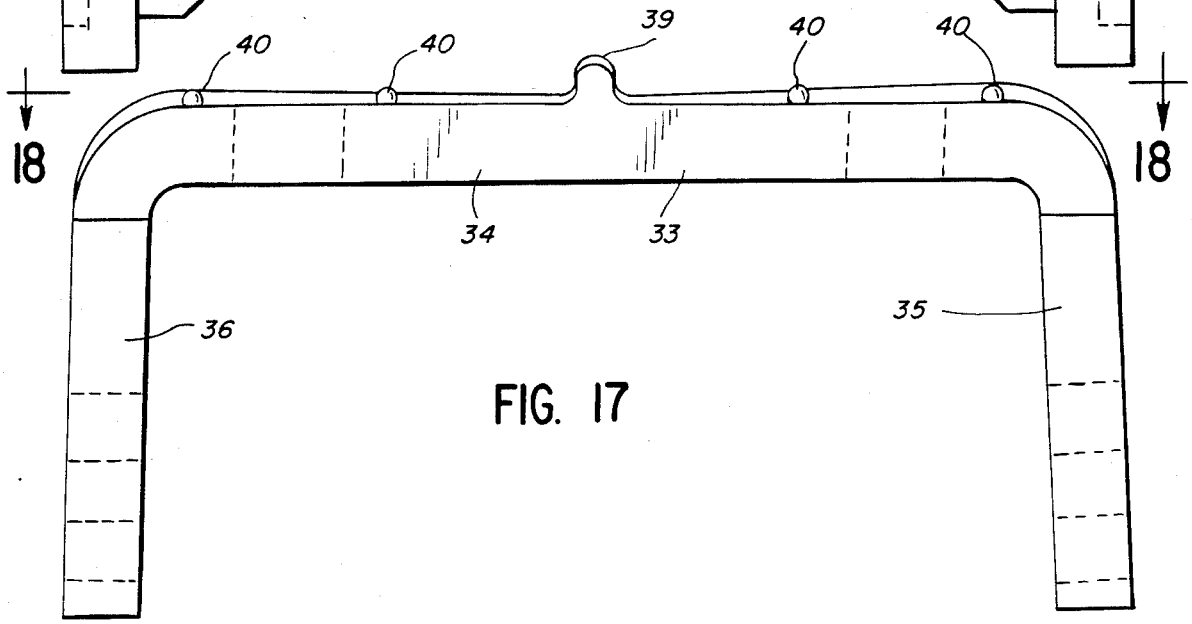
FIG. 17 is a top plan view of the mounting bracket taken along the line 17—17 of FIG. 16.
Figure 18:
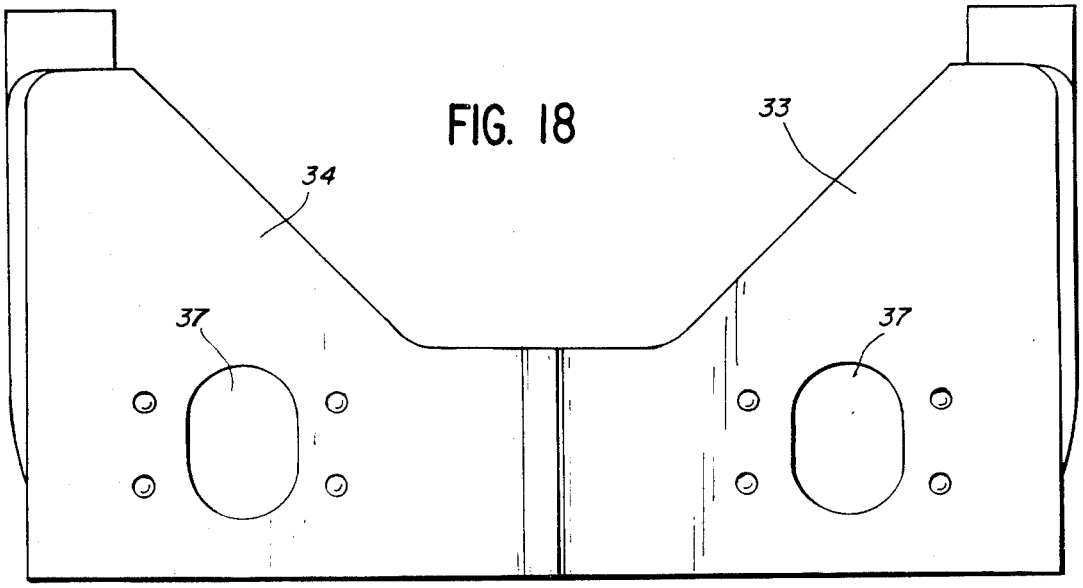
FIG. 18 is a rear plan view of the mounting bracket taken along the line 18—18 of FIG. 17.
Figure 19:
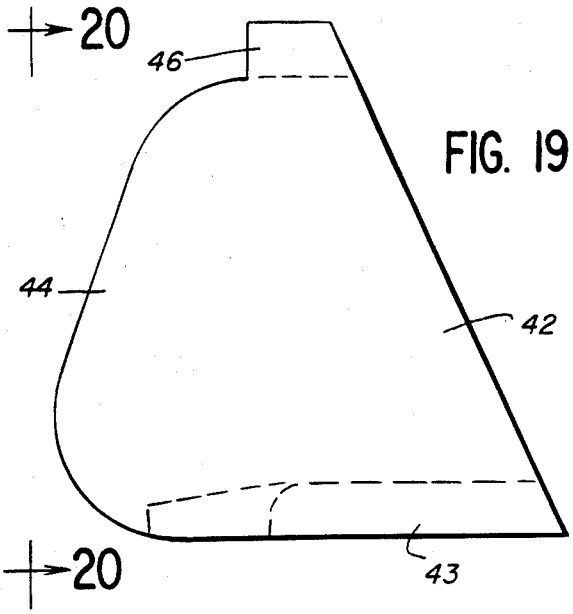
FIG. 19 is a side elevational view of the cover of the latch assembly as would be seen along the line 14—14 of FIG. 3.
Figure 22:
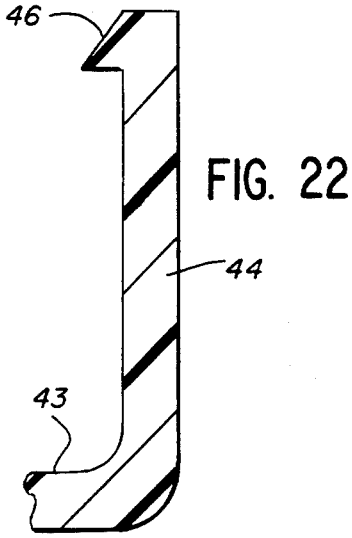
FIG. 22 is a fragmentary sectional view taken along the line 22—22 of FIG. 21.
Figure 21:
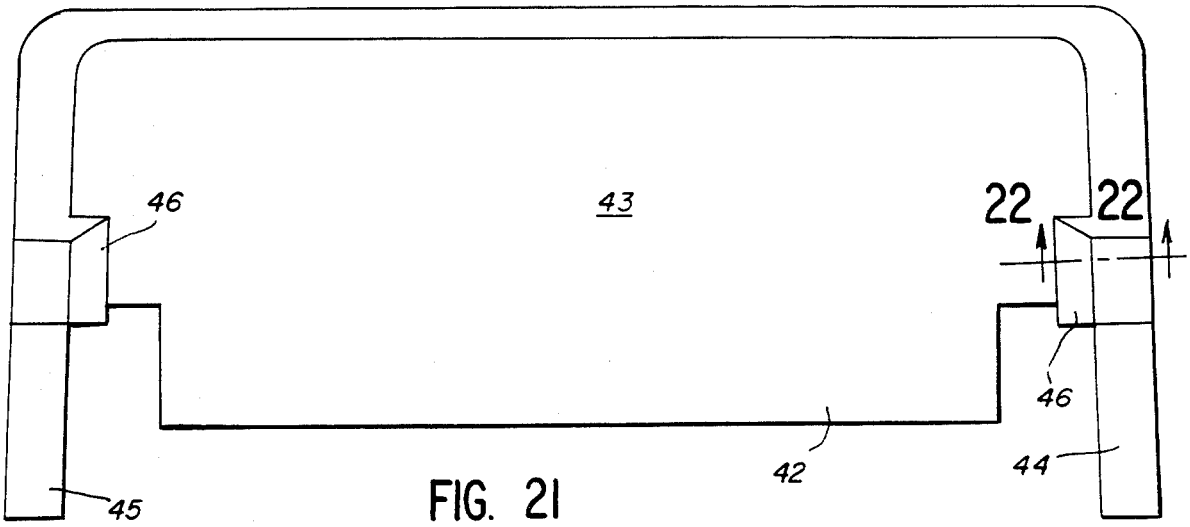
FIG. 21 is a top plan view of the cover taken along the line 21—21 of FIG. 20.
Figure 20:
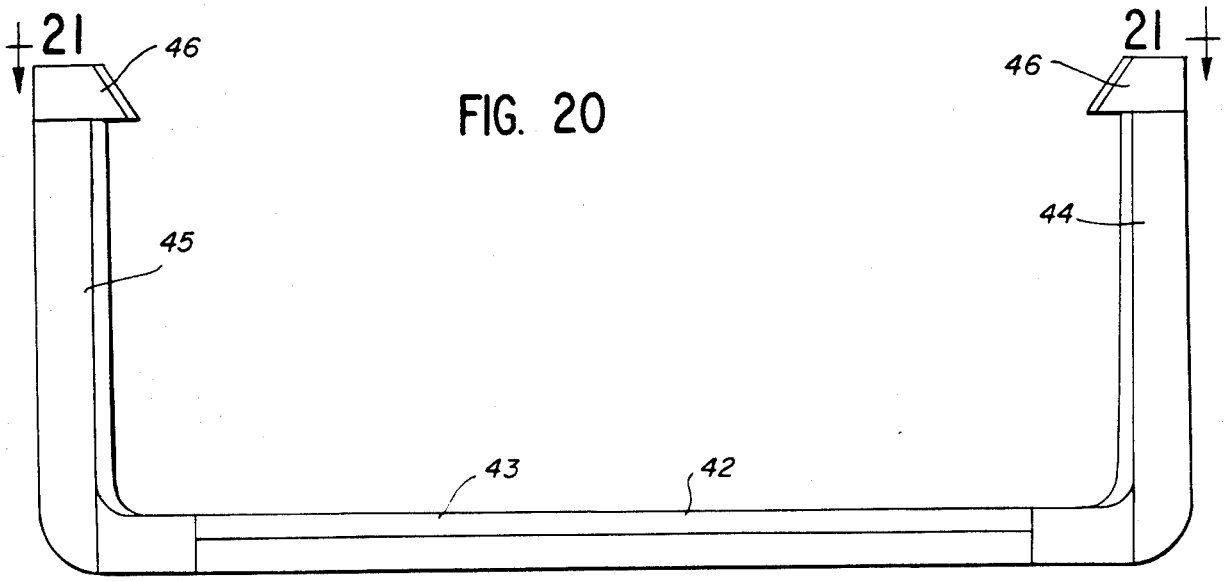
FIG. 20 is a front elevational view of the cover taken along the line 20—20 of FIG. 19.

Referring to FIGS. 11–13, the latch 30 includes a pivot portion 71, a latching portion 72, and an L-shaped connecting portion 73 which extends between the pivot portion and the latching portion. The pivot portion 71 is generally cylindrical and is sized to be inserted between the side walls 35 and 36 of the bracket 33. The ends of the pivot portion are provided with openings 74 and 75 which receive pivot pins 49 which extend through the openings 51 and 53, respectively, in the bracket 33.

A groove 76 is provided in the upper surface of the pivot portion 71 of the latch between a pair of projections 77 and 78. The groove has an arcuate or curved surface which is adapted to receive the projection 62 of the handle 29 when the two parts are mounted in the bracket 33. The center of the groove is radially aligned with the pivot axis 79 of the pivot portion.

The connecting portion 73 of the latch extends from the center of the pivot portion 71 (see FIG. 12) and includes a rearwardly extending portion 80 and a downwardly extending portion 81. The latching portion 72 includes an upper surface 82 which extends forwardly and downwardly from the connecting portion and a triangularly shaped rib 83 at the center of the latching portion. The rib includes a rearwardly and downwardly extending surface 84.

The latch assembly is assembled by inserting the handle 29 and the latch 30 between the side walls 35 and 36 of the bracket 33 and inserting four pins 49 through the openings 50–53 in the side walls to pivotally mount the handle and the latch. Thereafter, the cover 42 is snapped over the bracket 33 so that the side walls 44 and 45 of the cover retain the pins 49 in the holes 50–53.

The handle 29 and the latch 30 are mounted in the bracket 33 so that the projection 62 of the handle extends into the groove 76 in the latch as shown in FIGS. 4–6.

The distance between the pivot axes of the handle 29 and the latch 30 is less than the distance between the pivot axis of the handle 29 and the end of the projection 62 plus the distance between the pivot axis of the latch 30 and the bottom of the groove 76. Accordingly, the projection 62 and the groove 76 will ordinarily be on one side or the other of a centerline which extends between the two pivot axes. The material of the handle and latch is deformable and resilient so that the projection and/or groove can be deformed to permit the projection and the groove to move from one side of the centerline to the other when a sufficient pivoting force is applied to the handle or the latch.

In one specific embodiment both the handle and the latch were molded from Celanese acetal M 90-4 plastic. The outer curved surface of the projection 62 was about 0.205 inch from the pivot axis 63 of the handle, and the projection 62 extended about 0.091 inch beyond the pivot portion of the handle. The radius of the outer curved surface of the projection was 0.041 inch. The bottom of the groove 76 in the latch was about 0.125 inch from the pivot axis 79 of the latch, and the radius of the curved surface of the groove was about 0.049 inch. The projections 77 and 78 on the sides of the groove extended about 0.190 inch from the pivot axis 79.

In the foregoing specific embodiment the distance between the pivot axes 63 and 79 of the handle and the latch was about 0.319 inch. The distance between the pivot axis 63 and the end of the projection 62 was about 0.205 inch, and the distance between the pivot axis 79 and the bottom of the groove 76 was about 0.125 inch. The projection 62 and/or the groove 76 therefore had to be deformed about 0.011 inch to permit the projection and the groove to move from one side of the centerline between the axes to the other side.

The engagement between the projection 62 on the handle and the side surfaces of the groove 76 or the projections 77 and 78 on the latch cause the handle and the latch to pivot together. The projection 62 is retained within the groove 76 under normal forces by the projections 77 and 78, and the front surfaces 64 and 65 on the mounting bracket act as stops to prevent the handle and the latch from rotating sufficiently to permit the projection 62 to leave the groove 76.

The handle 29 and the latch 30 are shown in their latched positions in FIG. 4. The lid 26 is slightly open, and the latching portion 72 of the latch is above the base 27 of the cooler. As the lid is lowered, the downwardly angled surface 84 of the rib 83 of the latching portion will engage the rim of the base. If a sufficient closing force is exerted on the lid, the latching portion 72 will be cammed inwardly by the base. The counterclockwise pivoting of the latch caused by this camming action will move the projection 62 and the groove 76 over center and move the handle and the latch to their unlatched positions shown in FIG. 5. The lid is thereby permitted to close as shown in FIG. 5, but the latch will not be returned to its latched position without external manipulation of the latch assembly. This prevents the lid from being inadvertently latched in the closed position.

After the lid is closed, the latch can be moved from its unlatched position shown in FIG. 5 to its latched position shown in FIG. 6 by pivoting the handle 29 counterclockwise to move the projection 62 and the groove 76 over center. The handle acts as a lever which pivots the latch 30 clockwise to bring the latching portion 72 into the recess 31 in the base of the cooler. The engagement between the upper surface 82 of the latching portion and the upper surface 86 of the recess 31 will retain the lid in the closed position.

The engagement between the latching portion 72 of the latch and the upper surface of the recess 31 will retain the lid closed against a force which tends to open the lid unless the opening force exceeds a predetermined level. As the opening force approaches the predetermined level, the latching portion 72 flexes about its connection to the connecting portion 30. When the predetermined opening force is reached, substantially the entire opening force is resisted at the intersection of the angled upper surface 82 of the latching portion and the connecting portion 73 of the latch. This creates a flexing of connecting portion 73 which is sufficient to cam the latch over center to move the latch and the handle to their unlatched positions. The lid can thereby be opened by exerting a sufficient opening force without manipulating the latch assembly. Once the lid is opened, it cannot be latched shut again without external manipulation of the latch assembly.

When the lid is to be opened during normal use, the user merely grasps the lower edge of the handle 29 and exerts and upward force on the handle to pivot the handle clockwise from its latched position shown in FIG. 6. The handle and the latch will pivot over center to their unlatched positions, and the upward force exerted by the user on the handle will raise the lid in one continuous motion.

It will be appreciated from FIGS. 4–6 that the latch assembly has a minimum of protruding parts which can be damaged or cause injury. All of the moving parts of the latch assembly are mounted on the lid, and the latch assembly therefore does not interfere with cleaning of the base portion of the cooler.

While I have described the projection 62 and the groove 76 as being on the handle and the latch, respectively, these parts could be reversed so that the projection is on the latch and the groove is on the handle.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A latch assembly for a closure comprising:

a latch pivotally mounted on the closure for pivoting movement about a first axis between latched and unlatched positions, a lever pivotally mounted on the closure for pivoting movement about a second axis which is parallel to said first axis between latched and unlatched positions, interengaging means on the latch and on the lever for pivoting the latch from the latched position to the unlatched position when the lever is pivoted from the latched to the unlatched position and for pivoting the latch from the unlatched to the latched position when the lever is pivoted from the unlatched to the latched position, and a mounting bracket attached to said closure, said mounting bracket having a pair of parallel side portions and a pair of openings in each of the side portions, said latch being pivotally mounted in said bracket by a pair of pins which extend through one of the openings in each of the side portions of said bracket and into said latch, said lever being pivotally mounted in said bracket by a pair of pins which extend through the other opening in each of the side portions of said bracket and into said lever.

2. The latch assembly of claim 1 including a cover attached to said bracket, the cover including a pair of side portions which extend along the outside of the side portions of said bracket.

3. The latch assembly of claim 2 in which said pins are retained in said bracket by the side portions, of the cover.

4. The latch assembly of claim 2 in which said cover includes a bottom portion which extends between the side portions of the cover, said latch including a pivot portion which extends between the side portions of said bracket, an L-shaped connecting portion which extends from the pivot portion over the bottom portion of the cover, and a latching portion which is connected to the connecting portion below the bottom portion of the cover.

5. A latch assembly for a closure comprising:

a latch pivotally mounted on the closure for pivoting movement about a first axis between latched and unlatched positions, a lever pivotally mounted on the closure for pivoting movement about a second axis which is parallel to said first axis between latched and unlatched positions, and interengaging means on the latch and on the lever for pivoting the latch from the latched position to the unlatched position when the lever is pivoted from the latched to the unlatched position and for pivoting the latch from the unlatched to the latched position when the lever is pivoted from the unlatched to the latched position, said interengaging means comprising a groove on one of said latch and lever and a projection on the other of said latch and lever which extends into said groove, said groove and said projection lying generally along a line between the pivot axes of the latch and the lever, the groove and the projection moving from one side of said line to the other when the latch and the lever move between their latched and unlatched positions.

6. The latch assembly of claim 5 in which said groove is on said latch and said projection is on said lever.

7. The latch assembly of claim 6 in which the distance between the pivot axes of the latch and the lever is less than the sum of the distance between the pivot axis of the latch and the groove and the distance between the pivot axis of the lever and the end of said projection.

8. The latch assembly of claim 5 in which the distance between the pivot axes of the latch and the lever is less than the sum of the distance between the pivot axis of the latch and the groove and the distance between the pivot axis of the lever and the end of said projection.

9. The latch assembly of claim 5 in which said latch includes a latching portion and a flexible connecting portion between the latching portion and the pivot axis of the latch.

10. The latch assembly of claim 5 in which said closure is movably mounted on a base and is movable between open and closed positions, said latching portion including first and second camming surfaces, one of the camming surfaces adapted to engage the base when the closure is in its open position and the latch is in its latched position and the other camming surfaces adapted to engage the base when the latch is in its latched position and the closure moves from its closed position toward its open position, a predetermined force exerted by the closure on either of said camming surfaces causing the latch to pivot from its latched position to it unlatched position.

11. The latch assembly of claim 5 in which said lever forms a gripping handle which may be used to raise and lower the closure.

* * * * *